US010605093B2

(12) United States Patent
Hoskin et al.

(10) Patent No.: US 10,605,093 B2
(45) Date of Patent: Mar. 31, 2020

(54) HEAT TRANSFER DEVICE AND RELATED TURBINE AIRFOIL

(71) Applicant: General Electric Company, Schenectady, NY (US)

(72) Inventors: Robert Frank Hoskin, Duluth, GA (US); James Albert Tallman, Scotia, NY (US)

(73) Assignee: General Electric Company, Schenectady, NY (US)

( * ) Notice: Subject to any disclaimer, the term of this patent is extended or adjusted under 35 U.S.C. 154(b) by 747 days.

(21) Appl. No.: 15/207,729

(22) Filed: Jul. 12, 2016

(65) Prior Publication Data

US 2018/0016916 A1 Jan. 18, 2018

(51) Int. Cl.
*F01D 5/18* (2006.01)

(52) U.S. Cl.
CPC ..... *F01D 5/186* (2013.01); *F05D 2220/31* (2013.01); *F05D 2220/32* (2013.01); *F05D 2240/30* (2013.01); *F05D 2260/201* (2013.01); *F05D 2260/221* (2013.01)

(58) Field of Classification Search
CPC ..... F23R 3/002; F28F 13/12
See application file for complete search history.

(56) References Cited

U.S. PATENT DOCUMENTS 2,843,354 A 7/1958 Smith
3,575,528 A 4/1971 Beam, Jr. et al.
3,973,874 A 8/1976 Corsmeier et al.
3,975,901 A 8/1976 Hallinger et al.
4,023,731 A 5/1977 Patterson
4,304,093 A 12/1981 Schulze
4,363,599 A 12/1982 Cline et al.
(Continued)

FOREIGN PATENT DOCUMENTS

DE 4430302 A1 2/1996
DE 19823251 C1 7/1999
(Continued)

OTHER PUBLICATIONS

U.S. Appl. No. 15/164,311 Office Action, dated Sep. 7, 2018, 31 pages.

(Continued)

*Primary Examiner* — Woody A Lee, Jr.
(74) *Attorney, Agent, or Firm* — Dale Davis; Hoffman Warnick LLC

(57) ABSTRACT

Various embodiments include a heat transfer device, while other embodiments include a turbine component. In some cases, the device can include: a body portion having an inner surface and an outer surface, the inner surface defining an inner region; at least one aperture in the body portion, the at least one aperture positioned to direct fluid from the inner region through the body portion; and at least one fluid receiving feature formed in the outer surface of the body portion, the at least one fluid receiving feature positioned to receive post-impingement fluid from the at least one aperture, wherein the at least one aperture does not define any portion of the at least one fluid receiving feature, and the at least one fluid receiving feature segregates relatively higher velocity post-impingement fluid from relatively lower velocity fluid within an impingement cross-flow region.

14 Claims, 11 Drawing Sheets

(56) References Cited

U.S. PATENT DOCUMENTS

| | | | | |
|---|---|---|---|---|
| 4,443,389 | A | 4/1984 | Dodds | |
| 4,487,016 | A | 12/1984 | Schwarz et al. | |
| 4,613,280 | A | 9/1986 | Tate | |
| 4,805,398 | A | 2/1989 | Jourdain et al. | |
| 5,120,192 | A | 6/1992 | Ohtomo et al. | |
| 5,219,268 | A | 6/1993 | Johnson | |
| 5,259,730 | A | 11/1993 | Damlis et al. | |
| 5,297,386 | A | 3/1994 | Kervistin | |
| 5,363,654 | A | 11/1994 | Lee | |
| 5,591,002 | A | 1/1997 | Cunha et al. | |
| 5,593,278 | A | 1/1997 | Jourdain et al. | |
| 5,704,763 | A | 1/1998 | Lee | |
| 6,000,908 | A * | 12/1999 | Bunker | F01D 5/189 165/908 |
| 6,116,852 | A | 9/2000 | Pierre et al. | |
| 6,152,685 | A | 11/2000 | Hagi | |
| 6,179,557 | B1 | 1/2001 | Dodd et al. | |
| 6,227,800 | B1 | 5/2001 | Spring et al. | |
| 6,419,146 | B1 | 7/2002 | Buldhaupt et al. | |
| 6,422,807 | B1 | 7/2002 | Leach et al. | |
| 6,428,273 | B1 | 8/2002 | Keith et al. | |
| 6,435,813 | B1 | 8/2002 | Rieck, Jr. et al. | |
| 6,478,534 | B2 | 11/2002 | Bangert et al. | |
| 6,533,547 | B2 | 3/2003 | Anding et al. | |
| 6,554,563 | B2 | 4/2003 | Noe et al. | |
| 6,641,363 | B2 | 11/2003 | Barrett et al. | |
| 6,659,714 | B1 | 12/2003 | Tiemann | |
| 6,742,783 | B1 | 6/2004 | Lawer et al. | |
| 6,769,875 | B2 | 8/2004 | Tiemann | |
| 6,779,597 | B2 | 8/2004 | DeMarche et al. | |
| 6,824,351 | B2 | 11/2004 | Endries et al. | |
| 6,877,952 | B2 | 4/2005 | Wilson | |
| 6,925,814 | B2 | 8/2005 | Wilson et al. | |
| 7,270,175 | B2 * | 9/2007 | Mayer | F01D 25/08 165/170 |
| 7,347,671 | B2 | 3/2008 | Dorling et al. | |
| 7,434,402 | B2 | 10/2008 | Paprotna et al. | |
| 7,556,476 | B1 | 7/2009 | Liang | |
| 7,658,591 | B2 | 2/2010 | Dervaux et al. | |
| 7,740,444 | B2 | 6/2010 | Lee et al. | |
| 7,798,775 | B2 | 9/2010 | Kammel et al. | |
| 7,997,867 | B1 * | 8/2011 | Shih | F01D 5/186 415/115 |
| 8,127,553 | B2 | 3/2012 | Ekkad et al. | |
| 8,128,341 | B2 | 3/2012 | Wieghardt | |
| 8,137,055 | B2 | 3/2012 | Lang | |
| 8,403,631 | B2 | 3/2013 | Surace et al. | |
| 8,549,864 | B2 | 10/2013 | Langdon, II et al. | |
| 8,616,827 | B2 | 12/2013 | O'Leary | |
| 8,667,682 | B2 * | 3/2014 | Lee | B21K 3/00 29/890.01 |
| 8,684,660 | B2 | 4/2014 | Miranda et al. | |
| 9,145,779 | B2 * | 9/2015 | Joe | F01D 9/04 |
| 9,243,801 | B2 * | 1/2016 | Cunha | F23R 3/002 |
| 9,404,389 | B2 | 8/2016 | Erickson et al. | |
| 9,506,369 | B2 | 11/2016 | Boswell et al. | |
| 9,631,808 | B2 | 4/2017 | Taylor et al. | |
| 9,638,057 | B2 * | 5/2017 | Kwon | F01D 5/186 |
| 9,719,372 | B2 | 8/2017 | Ballard, Jr. et al. | |
| 9,777,636 | B2 | 10/2017 | Morrill | |
| 9,926,801 | B2 | 3/2018 | Uskert et al. | |
| 9,945,250 | B2 | 4/2018 | Kitamura et al. | |
| 10,030,537 | B2 | 7/2018 | Dutta et al. | |
| 2002/0071762 | A1 | 6/2002 | Schroder | |
| 2003/0035722 | A1 | 2/2003 | Barrett et al. | |
| 2005/0118023 | A1 * | 6/2005 | Bunker | F01D 5/187 416/97 R |
| 2010/0247297 | A1 | 9/2010 | Legare et al. | |
| 2011/0027068 | A1 | 2/2011 | Floyd, II et al. | |
| 2011/0135456 | A1 | 6/2011 | Takahashi et al. | |
| 2012/0070302 | A1 | 3/2012 | Lett | |
| 2012/0247297 | A1 | 10/2012 | Kawaguchi et al. | |
| 2012/0247121 | A1 | 11/2012 | Kitamura et al. | |
| 2013/0017060 | A1 | 1/2013 | Boswell et al. | |
| 2015/0098791 | A1 | 4/2015 | Ballard, Jr. et al. | |
| 2015/0110612 | A1 | 4/2015 | Brandl et al. | |
| 2016/0333701 | A1 * | 11/2016 | Lewis | F01D 5/187 |
| 2017/0030200 | A1 * | 2/2017 | Kruckels | F01D 5/187 |
| 2017/0030201 | A1 * | 2/2017 | Rao | F23R 3/002 |
| 2017/0292389 | A1 | 10/2017 | Lorstad et al. | |
| 2017/0284218 | A1 | 11/2017 | Kondo et al. | |
| 2018/0066527 | A1 | 3/2018 | Kadau et al. | |
| 2019/0046949 | A1 * | 2/2019 | Hirschberg | B01D 3/00 |

FOREIGN PATENT DOCUMENTS

| | | | |
|---|---|---|---|
| EP | 1152125 | A1 | 11/2001 |
| EP | 1780376 | A1 | 5/2007 |
| EP | 1806476 | A1 | 7/2007 |
| EP | 2243933 | A1 | 4/2009 |
| EP | 2410128 | A1 | 1/2012 |

OTHER PUBLICATIONS

U.S. Appl. No. 15/175,597, Office Action dated Oct. 15, 2018, 31 pages.

U.S. Appl. No. 15/207,743, Office Action dated Oct. 30, 2018, 33 pages.

U.S. Appl. No. 13/461,035, Notice of Allowance dated Jun. 12, 2017, 10 pages.

U.S. Appl. No. 15/164,311 Notice of Allowance dated Jan. 10, 2019, 11 pages.

U.S. Appl. No. 15/175,597, Final Office Action dated Jan. 30, 2019, 15 pages.

U.S. Appl. No. 13/461,035, Office Action 3 dated Feb. 14, 2017, 19 pages.

U.S. Appl. No. 13/461,035, Office Action 2 dated Aug. 19, 2016, 24 pages.

U.S. Appl. No. 13/461,035, Office Action 1 dated Dec. 17, 2014, 15 pages.

U.S. Appl. No. 13/461,035, Final Office Action 1 dated Apr. 22, 2015, 19 pages.

EP Search Report and Written Opinion dated May 6, 2014 in connection with corresponding EP Patent Application No. 13165921.1.

U.S. Appl. No. 15/175,576, Office Action dated Feb. 25, 2019, 19 pages.

U.S. Appl. No. 15/175,597, Notice of Allowance dated Apr. 11, 2019, 9 pgs.

U.S. Appl. No. 15/175,576 Final Office Action dated Jun. 26, 2019, 19 pgs.

* cited by examiner

HEAT TRANSFER DEVICE AND RELATED TURBINE AIRFOIL

FIELD OF THE INVENTION

The present disclosure relates to heat transfer. More particularly, the present invention is directed to a heat transfer device and approaches for transferring heat from an article such as a turbine airfoil.

BACKGROUND OF THE INVENTION

Turbine systems are continuously being modified to increase efficiency and decrease cost. One method for increasing the efficiency of a turbine system includes increasing the operating temperature of the turbine system. However, operating at high temperatures for extended periods often requires using newer materials capable of withstanding those conditions.

In addition to modifying component materials and coatings, one common method of increasing temperature capability of a turbine component includes the use of impingement cooling. Impingement cooling generally includes directing a cooling fluid through one or more apertures within an inner region of an article, the cooling fluid contacting (i.e., impinging upon) an inner surface of the article, which in turn cools the article. After impinging upon the inner surface of the article, a post-impingement fluid is typically directed away from the impinged surface, creating a cross flow within the inner region.

Usually, the cross flow includes higher velocity post-impingement fluid, known in the art as post-impingement wall jets, and lower velocity fluid between and adjacent the wall jets. Mixing of the higher velocity and lower velocity fluids usually happens in an inefficient manner, and causes relatively greater pressure losses in the cross flow, e.g., the cross flow has a relatively lower pressure head to provide additional function such as additional or sequential impingement cooling. A relatively lower pressure head can require additional cooling air, which is undesirable.

BRIEF DESCRIPTION OF THE INVENTION

Various embodiments include a heat transfer device, while other embodiments include a turbine component, such as an airfoil. In some cases, the device can include: a body portion having an inner surface and an outer surface, the inner surface defining an inner region; at least one aperture in the body portion, the at least one aperture positioned to direct fluid from the inner region through the body portion; and at least one fluid receiving feature formed in the outer surface of the body portion, the at least one fluid receiving feature positioned to receive post-impingement fluid from the at least one aperture, wherein the at least one aperture does not define any portion of the at least one fluid receiving feature, and the at least one fluid receiving feature segregates relatively higher velocity post-impingement fluid from relatively lower velocity fluid within an impingement cross-flow region.

A first aspect of the disclosure includes a device having: a body portion having an inner surface and an outer surface, the inner surface defining an inner region; at least one aperture in the body portion, the at least one aperture positioned to direct fluid from the inner region through the body portion; and at least one fluid receiving feature formed in the outer surface of the body portion, the at least one fluid receiving feature positioned to receive post-impingement fluid from the at least one aperture, wherein the at least one aperture does not define any portion of the at least one fluid receiving feature, and the at least one fluid receiving feature segregates relatively higher velocity post-impingement fluid from relatively lower velocity fluid within an impingement cross-flow region.

A second aspect of the disclosure includes a turbine component having: a body portion having an inner surface and an outer surface, the inner surface defining an inner region, wherein the inner region includes a first set of passageways having a first volume and a second set of passageways fluidly coupled with the first set of passageways, the second set of passageways having a second volume distinct from the first volume; and at least one aperture in the body portion, the at least one aperture positioned to direct fluid from the second set of passageways through the body portion to the outer surface.

A third aspect of the disclosure includes a device having: a body portion having an inner surface and an outer surface, the inner surface defining an inner region; at least one aperture in the body portion, the at least one aperture positioned to direct fluid from the inner region through the body portion; and at least one fluid receiving feature formed in the outer surface of the body portion, the at least one fluid receiving feature positioned to receive post-impingement fluid from the at least one aperture; wherein the at least one fluid receiving feature segregates relatively higher velocity post-impingement fluid from relatively lower velocity fluid within an impingement cross-flow region.

Wherever possible, the same reference numbers will be used throughout the drawings to represent the same parts. Other features and advantages of the various embodiments of the disclosure will be apparent from the following more detailed description, taken in conjunction with the accompanying drawings which illustrate, by way of example, various aspects of the disclosure.

DETAILED DESCRIPTION OF THE INVENTION

Various embodiments of the disclosure include a device for cooling an article, while other embodiments include methods of cooling an article. Embodiments of the present disclosure, for example, in comparison to concepts failing to include one or more of the features disclosed herein, increase cooling efficiency, reduce cross flow, reduce cross flow degradation, reduce pressure loss, provide increased heat transfer with reduced pressure drop, facilitate reuse of cooling fluid, facilitates series impingement cooling, increase article life, facilitate use of increased system temperatures, increase system efficiency, or a combination thereof.

Figure 1:
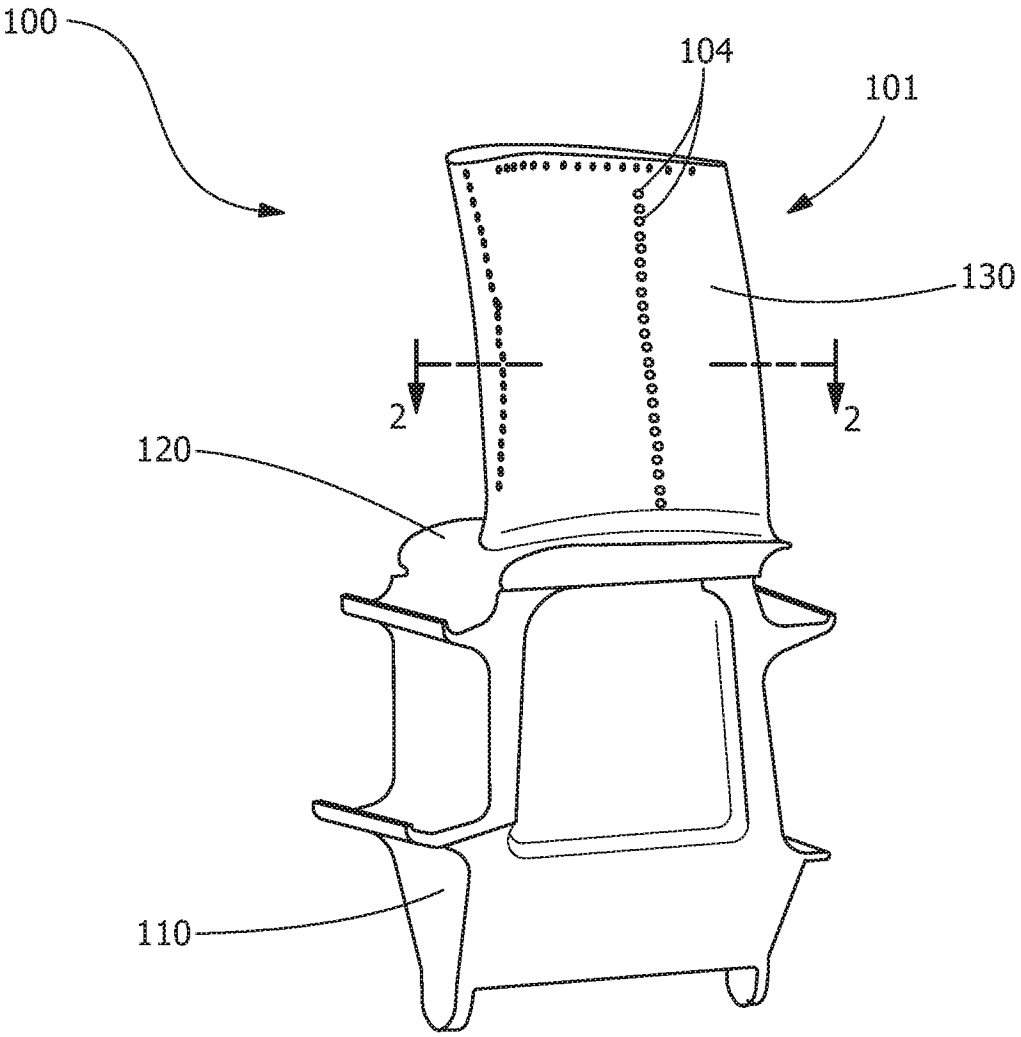
FIG. 1 is a front perspective view of an article, according to various embodiments of the disclosure.
Figure 2:
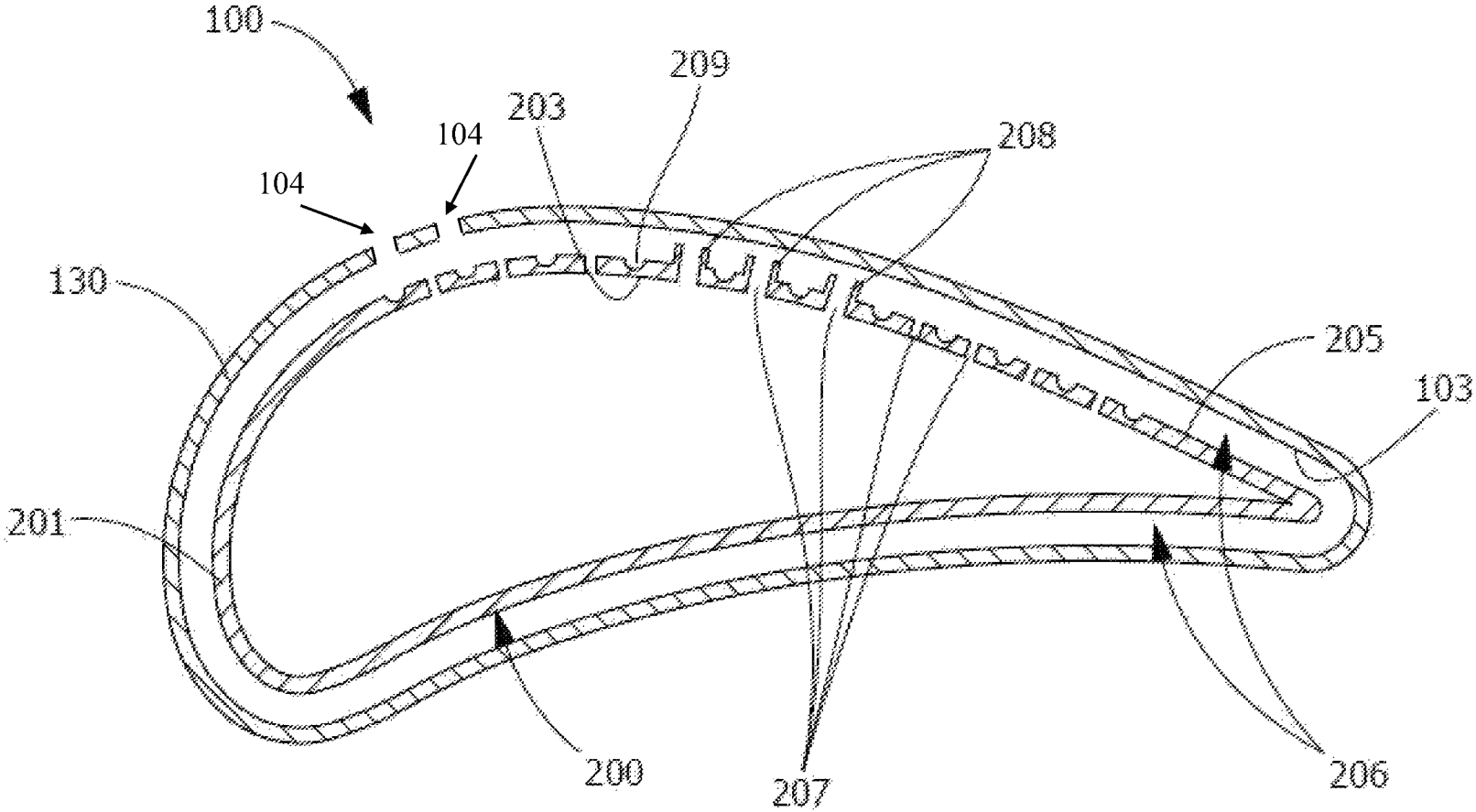
FIG. 2 is a section view of the article of FIG. 1, taken in direction 2-2, according to various embodiments of the disclosure.
Figure 3:
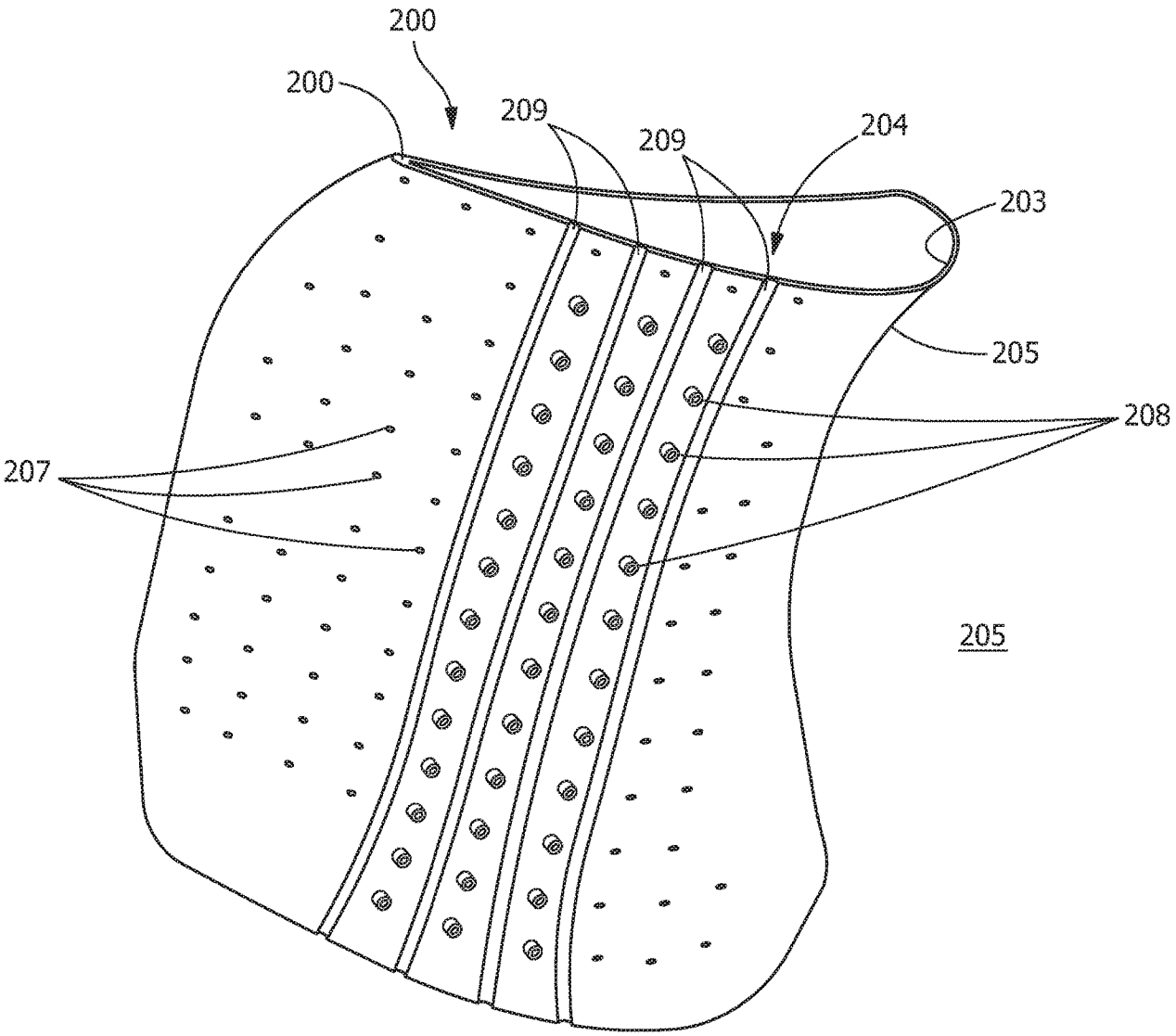
FIG. 3 is a perspective view of a device, according to various embodiments of the disclosure.

FIGS. 1-3 illustrate one embodiment of an article 100 (FIGS. 1-2) and a device 200 (FIGS. 2-3) positioned within the article 100. The article 100 and/or the device 200 are formed according to any suitable manufacturing method. Suitable manufacturing methods include, but are not limited to, casting, machining, additive manufacturing, or a combination thereof. For example, additive manufacturing of device 200 may include direct metal laser melting (DMLM), direct metal laser sintering (DMLS), selective laser melting (SLM), selective laser sintering (SLS), fused deposition modeling (FDM), any other additive manufacturing technique, or a combination thereof.

Referring to FIG. 1, in one embodiment, article 100 includes, but is not limited to, a turbine bucket 101 (or blade). In various embodiments, turbine bucket 101 is configured to be installed in a turbine system, such as a gas turbine or steam turbine, and may be one of a set of turbine buckets 101 in a particular stage. As shown, turbine bucket 101 has a root portion 110, a platform 120 coupled with root portion 110, and an airfoil portion 130 coupled with platform 120. Root portion 110 is configured to secure turbine bucket 101 within a turbine system, such as, for example, to a rotor wheel, as is known in the art. Additionally, root portion 110 is configured to receive a fluid (e.g., a heat transfer fluid) from the turbine system and direct the fluid into airfoil portion 130.

Turning to FIGS. 2-3, device 200 includes a body portion 201 having an inner surface 203, an outer surface 205 opposing the inner surface, and at least one aperture 207 extending between inner surface 203 and outer surface 205. Body portion 201 can further include at least one fluid receiving feature 209 formed therein. In various embodiments, the at least one aperture 207 does not define any portion of the at least one fluid receiving feature 209, that is, they are separate components. Inner surface 203 of device 200 defines an inner region 204 (e.g., such as an internal channel or chamber), where inner region 204 is configured to receive a heat transfer (e.g., cooling) fluid therein. When device 200 is positioned within article 100, as shown in FIG. 2, outer surface 205 of device 200 faces an inner wall 103 of article 100, defining an outer region 206 (e.g., such as a channel or chamber) between outer surface 205 and inner wall 103.

The at least one aperture 207 is positioned to allow fluid flow from inner region 204, through body portion 201, and into outer region 206. At least one of the aperture(s) 207 is configured (e.g., positioned) to direct the heat transfer (e.g., cooling) fluid from inner region 204 toward inner wall 103 of article 100. Additionally or alternatively, a nozzle 208 is formed over at least one of the aperture(s) 207, the nozzle 208 extending from the outer surface 205 of the body portion 201 (toward inner wall 103) to extend and/or modify a flow path of the heat transfer (e.g., cooling) fluid exiting aperture(s) 207. Nozzle(s) 208 may have any suitable height (extending from outer surface) and/or geometry, which may be the same, substantially the same, or different for each of the other nozzle(s) 208.

Figure 4:
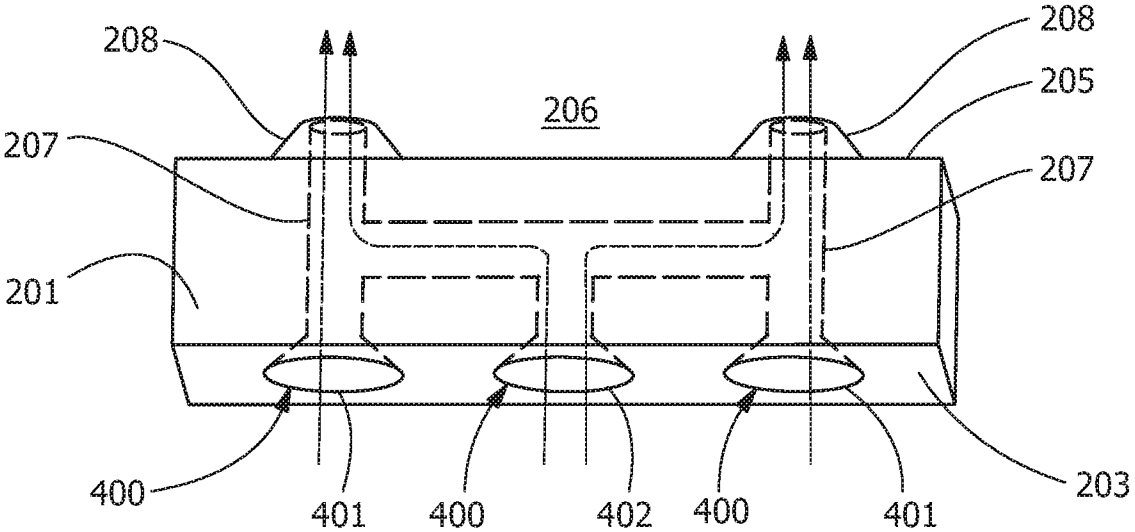
FIG. 4 is a rear perspective view of a portion of a device, according to various embodiments of the disclosure.

Referring to FIG. 4, in one embodiment, at least one bellmouth 400 is formed on inner surface 203 of body portion 201. Each of the bellmouth(s) 400 is fluidly coupled to one or more of apertures 207 and configured to direct the heat transfer (e.g., cooling) fluid from inner region 204 to aperture(s) 207 coupled thereto. In another embodiment, a sloped, graded, and/or rounded inlet of bellmouth 400 facilitates fluid flow therein, which reduces inlet loss of aperture 207 as compared to other apertures without inlet features or transitions.

Additionally or alternatively, two or more bellmouths 400 may be coupled to each aperture 207. For example, the at least one bellmouth 400 may include a primary bellmouth 401 and at least one secondary bellmouth 402. Primary bellmouth 401 is aligned with one of the apertures 207 and configured to direct the heat transfer (e.g., cooling) fluid from inner region 204 directly to aperture 207 aligned therewith. Secondary bellmouth 402 is adjacent to one or more primary bellmouths 401 and is configured to direct the heat transfer (e.g., cooling) fluid from the inner region 204 to at least one aperture 207 that is not aligned therewith. Each secondary bellmouth 402 may feed multiple apertures 207 and/or one of apertures 207 may be fed by multiple secondary bellmouths 402. By coupling aperture 207 to multiple bellmouths 400, if one bellmouth 400 becomes partially or completely blocked the heat transfer (e.g., cooling) fluid from the other bellmouths 400 supplements and/or replaces the heat transfer (e.g., cooling) fluid from the blocked bellmouth, which facilitates the use of apertures 207 having decreased inner diameters 405.

Figure 5:
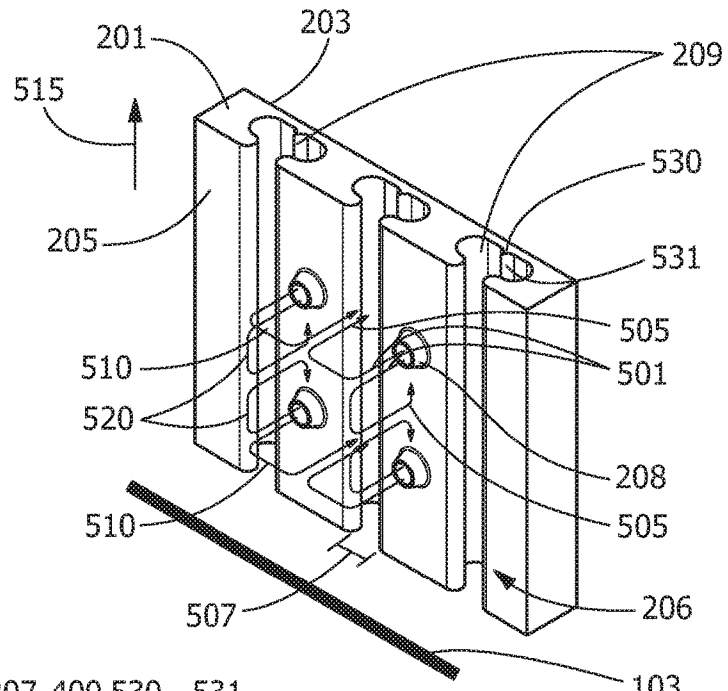
FIG. 5 is a front perspective view of a portion of an article, showing a flow profile within the article according to various embodiments of the disclosure.

As illustrated in FIG. 5, the heat transfer (e.g., cooling) fluid exiting aperture(s) 207 and/or the nozzle(s) 208 (FIG. 4) contacts the inner wall 103 (shown only partially depicted), which provides impingement cooling of article 100 (FIG. 2). Upon exiting aperture(s) 207 and/or nozzle(s) 208, the heat transfer (e.g., cooling) fluid forms a pre-impingement fluid flow 501, travelling from outer surface 205 towards inner wall 103. Upon contacting inner wall 103, pre-impingement fluid flow 501 forms an impingement fluid flow 503, which travels along the inner wall 103. Impingement fluid flow 503 then forms a post-impingement fluid flow 505, which travels from inner wall 103 back toward outer surface 205 of device 200.

Figure 6:
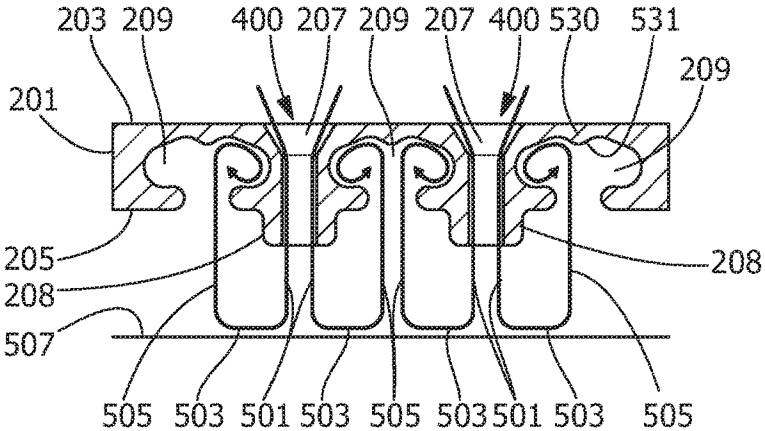
FIG. 6 is a top view of the flow profile shown in FIG. 5, according to various embodiments of the disclosure.

As will be appreciated by those skilled in art, upon contacting inner wall 103 the pre-impingement fluid flow 501 from each of aperture(s) 207 and/or nozzle(s) 208 forms multiple impingement fluid flows 503 travelling along inner wall 103. Referring to FIGS. 5 and 6, the multiple impingement fluid flows 503 are shown generally as perpendicular impingement fluid flows 510 or parallel impingement fluid flows 520, with respect to a cross flow direction 515 (direction of fluid flow across outer surface 205) in outer region 206. Without wishing to be bound by theory, it is believed that the interaction of two or more impingement fluid flows 503 travelling in opposing or substantially opposing directions generates a fountain region or wall jet, which forms post-impingement fluid flow 505 travelling away from inner wall 103 of article 100. For example, the impingement fluid flow 503 travelling in a first direction from one of apertures 207 and/or nozzles 208 may interact with the impingement fluid flow 503 travelling in an opposing second direction from another aperture 207 and/or nozzle 208, whereby the interaction of the impingement fluid flows 503 travelling in opposing directions generates a wall jet between the apertures 207 and/or nozzles 208. When multiple impingement fluid flows 503 travelling in opposing directions interact, they may form multiple wall jets that may be generally perpendicular or generally parallel to cross flow direction 515.

Figure 7:
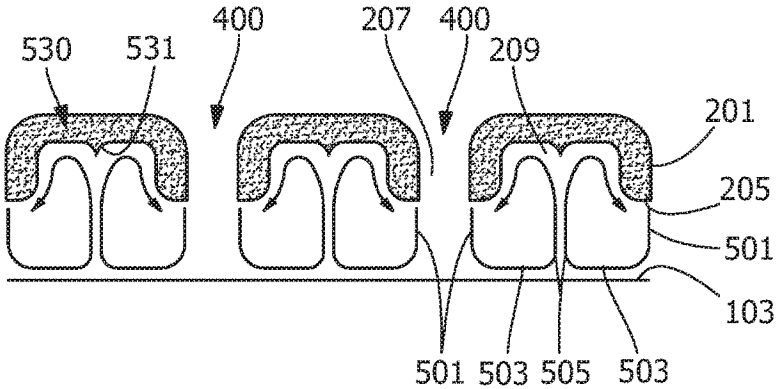
FIG. 7 is a top view of the flow profile shown in FIG. 5, according to various additional embodiments of the disclosure.

Turning to FIGS. 5-7, the one or more fluid receiving features 209 are configured to receive the cooling fluid from at least one of the post-impingement fluid flows 505. In one embodiment, for example, the one or more fluid receiving features 209 are configured to receive post-impingement fluid flow 505. In another embodiment, as illustrated in FIGS. 5-6, the fluid receiving feature 209 is partially enclosed within body portion 201, e.g., such that fluid receiving feature 209 is formed at least partially within body portion 201. When partially enclosed within body portion 201, fluid receiving feature 209 includes an opening 507 through outer surface 205, where opening 507 has a decreased (lesser) dimension as compared to fluid receiving feature 209. In a further embodiment, fluid receiving feature 209 retains or substantially retains post-impingement fluid flow 505 that passes through the opening 507. As used herein, the term "retains" can refer to at least 95% of post-impingement fluid 505 that enters fluid receiving feature 209 remaining therein (e.g., after impingement flow has exited). Additionally, as used herein, the term "substantially retains" can refer to at least 80% of the post-impingement fluid 505 that enters the fluid receiving feature 209 remaining therein. In other embodiments, an amount of post-impingement fluid 505 remaining within fluid receiving feature 209 after passing through the opening 507 is at least 50%, at least 60%, at least 70%, at least 75%, between 60% and 80%, between 70% and 80%, or any combination, sub-combination, range, or sub-range thereof.

Figure 8:
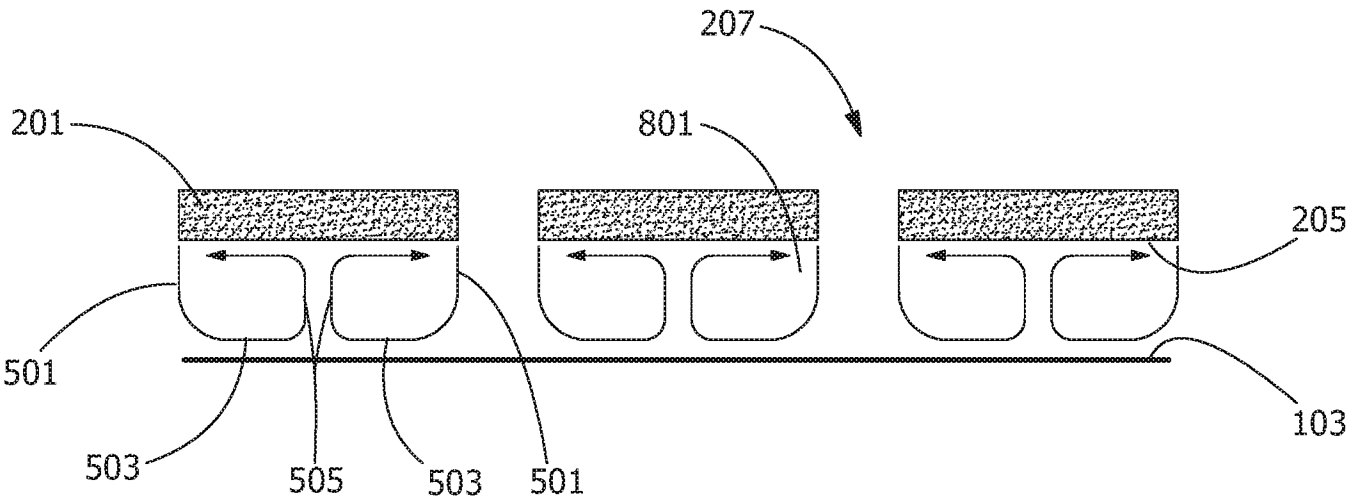
FIG. 8 (Prior Art)
FIG. 8 is a schematic view of a flow profile within a prior art device.

In an another embodiment, as illustrated in FIG. 7, fluid receiving feature 209 is formed in, but not enclosed by, body portion 201. When not enclosed by body portion 201, post-impingement fluid 505 enters fluid receiving feature 209, is redirected therein, and exits fluid receiving feature 209 in a direction other than perpendicular to the pre-impingement fluid flow 501. In contrast, the post-impingement fluid flow 505 of current impingement cooling devices, an example of which is shown in FIG. 8, contacts outer surface 205, travels along outer surface 205, and then intersects 801 the pre-impingement fluid flow 501 in a generally perpendicular direction. As compared with this prior art configuration, by retaining, substantially retaining, and/or redirecting the post-impingement fluid flow 505, fluid receiving feature(s) 209 formed according to one or more of the embodiments disclosed herein reduce cross flow in the outer region 206, reduce pressure drop and/or degradation of the pre-impingement fluid flow 501, or a combination thereof. That is, fluid receiving feature(s) 209 can segregate relatively higher velocity post-impingement fluid 505 from relatively lower velocity fluid within an impingement cross-flow region (outer region 206). The reduced cross flow and/or reduced pressure drop can increase cooling efficiency, facilitate use of increased system temperatures, increase system efficiency, or a combination thereof.

Figure 9:
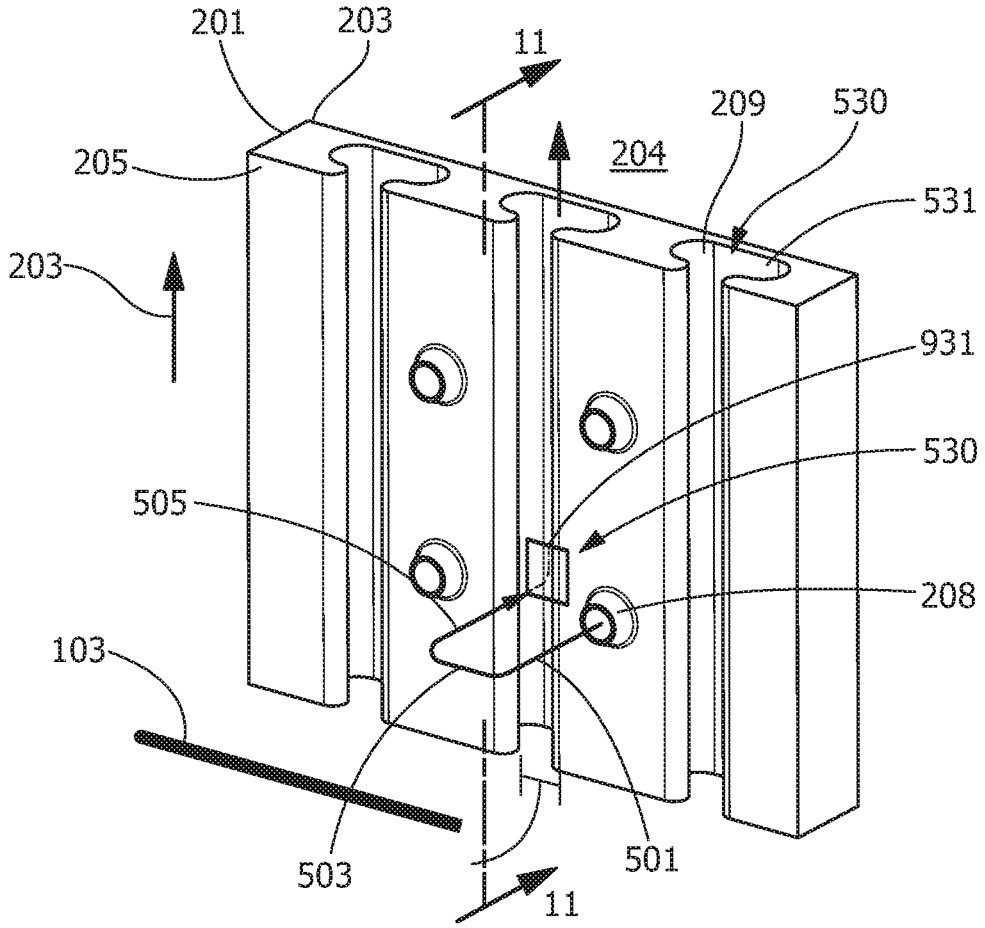
FIG. 9 is a front perspective view of a portion of an article, showing a flow profile within the article according to various additional embodiments of the disclosure.
Figure 10:
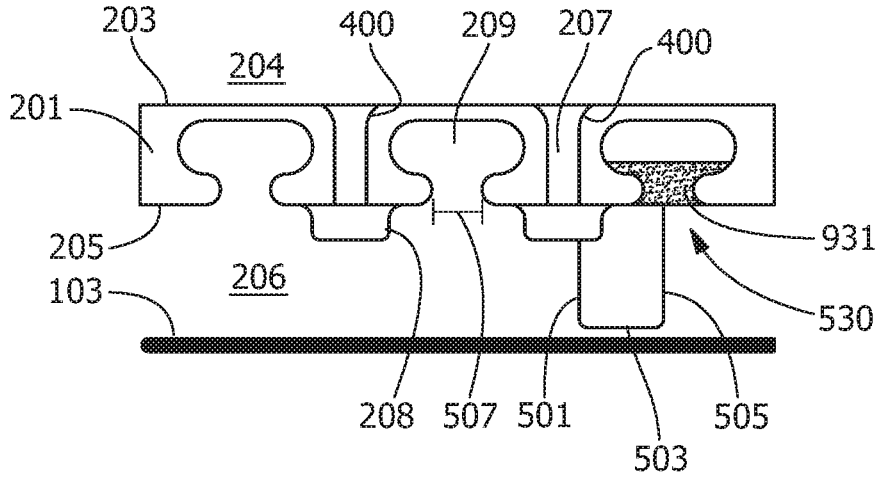
FIG. 10 is a top view of the flow profile shown in FIG. 9, according to various additional embodiments of the disclosure.

Returning to FIGS. 5-7, in one embodiment, fluid receiving feature 209 includes a fluid directing feature 530 such as a channel or depression. In another embodiment, fluid directing feature 530 includes a projection 531 formed within the fluid receiving feature 209. For example, projection 531 may include a raised portion extending from the surface of fluid receiving feature 209 and having any suitable geometry for directing the fluid entering fluid receiving feature 209. One suitable geometry includes a triangular and/or semi-circular raised portion. Other suitable geometries include, but are not limited to, polygonal, oval, rounded, or a combination thereof. In another embodiment, as illustrated in FIGS. 9-10, fluid directing feature 530 includes a turning vane 931 positioned within opening 507 of fluid receiving feature 209. The turning vane 931 receives post-impingement fluid flow 505 and directs the flow into fluid receiving feature 209 with a desired flow path. In these embodiments, as discussed with respect to FIGS. 5-7, fluid receiving feature(s) 209 (including, e.g., fluid directing feature 230) can segregate relatively higher velocity post-impingement fluid 505 from relatively lower velocity fluid (pre-impingement fluid flow 501) within an impingement cross-flow region (outer region 206).

Figure 11:
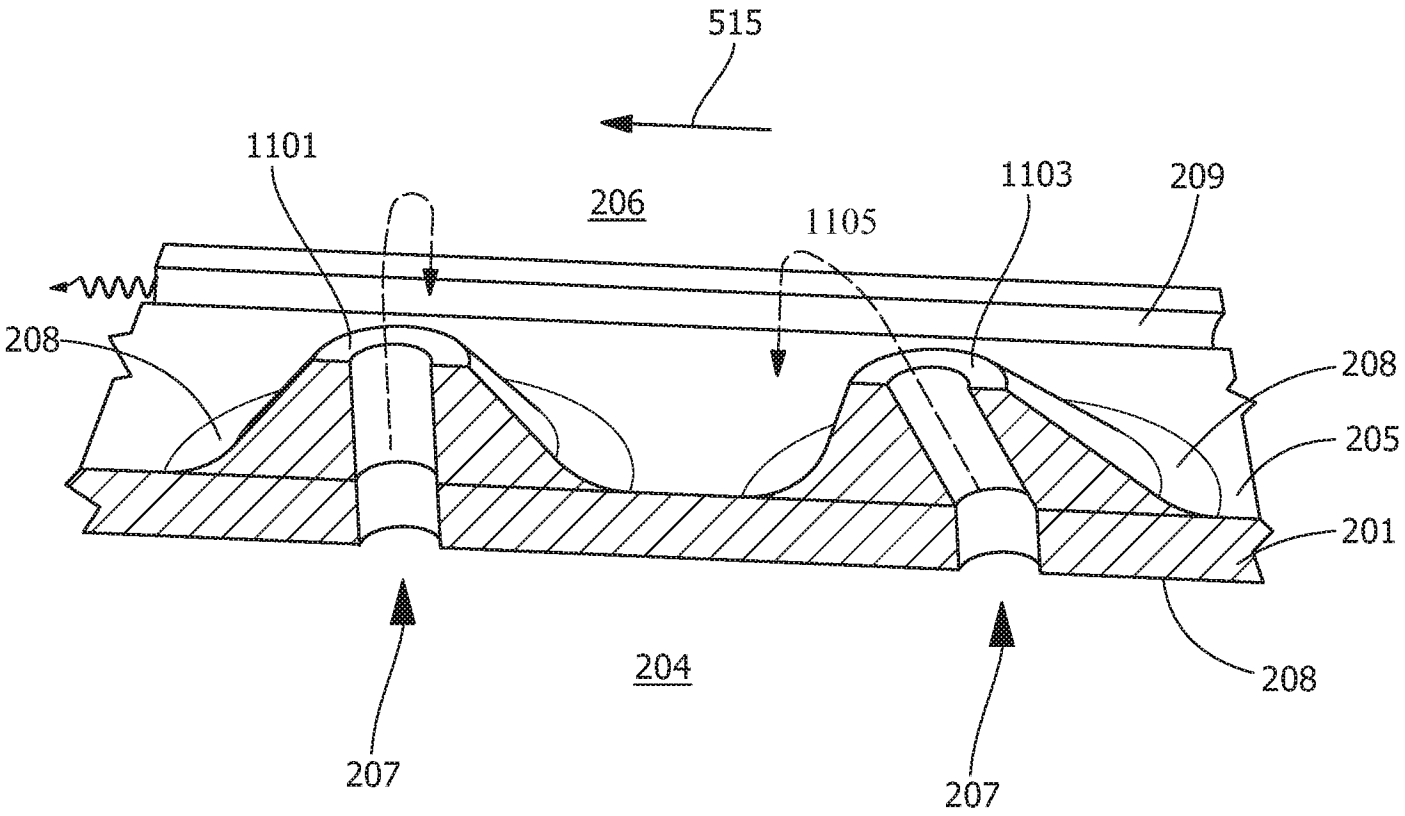
FIG. 11 is a section view of the article of FIG. 9, taken in direction 11-11, according to various additional embodiments of the disclosure.

Additionally or alternatively, the aperture(s) 207 and/or the nozzle(s) 208 may be configured to direct the fluid into fluid receiving feature 209. For example, in one embodiment, as illustrated in FIG. 11, a passageway 1103 extending through nozzle 208 is angled with respect to outer surface 205 of body portion 201. In another embodiment, an angle 1105 of the passageway 1103 partially directs the fluid in the cross flow direction 515. The angle 1105 of passageway 1103 includes any suitable angle other than perpendicular (i.e., 90° with respect to the outer surface 205) for directing the cooling fluid toward inner wall 103 of the article 100. Suitable angles 1105 of the passageway 1103 with respect to the outer surface 205, include, but are not limited to, between 60° and 89°, between 70° and 89°, between 70° and 85°, between 75° and 89°, between 75° and 85°, between 75° and 80°, or any combination, sub-combination, range, or sub-range thereof. In addition, aperture(s) 207 may be similarly angled with or without the nozzle 208 positioned thereover.

In contrast to passageways 1101 that are perpendicular with outer surface 205 which direct the pre-impingement fluid flow 501 perpendicular or substantially perpendicular to the cross flow direction 515, the angle 1105 of the passageway 1103 directs pre-impingement fluid flow 501 in cross flow direction 515. By directing a portion of pre-impingement fluid flow 501 in cross flow direction 515, the angle 1105 of the passageway 1103 increases a fluid velocity of both pre-impingement fluid flow 501 and post-impingement fluid flow 505 in cross flow direction 515. In a further embodiment, the increased fluid velocity of post-impingement fluid flow 505 increases the fluid velocity within fluid receiving feature 209, which in turn entrains the cross flow away from the fluid jets exiting aperture(s) 207 and/or nozzle(s) 208.

In certain embodiments, after receiving post-impingement fluid flow 505, fluid receiving feature(s) 209 route the flow to one or more predetermined locations within article 100 and/or device 200. For example, in one embodiment, fluid receiving feature(s) 209 may route the post-impingement fluid received therein to one or more film cooling holes 104 in article 100 (e.g., film cooling holes formed flush or substantially flush with an outer surface of an article, e.g., FIG. 1 and FIG. 2). In another embodiment, fluid receiving feature(s) 209 route the post-impingement fluid for re-use and/or series impingement cooling configurations.

Figure 12:
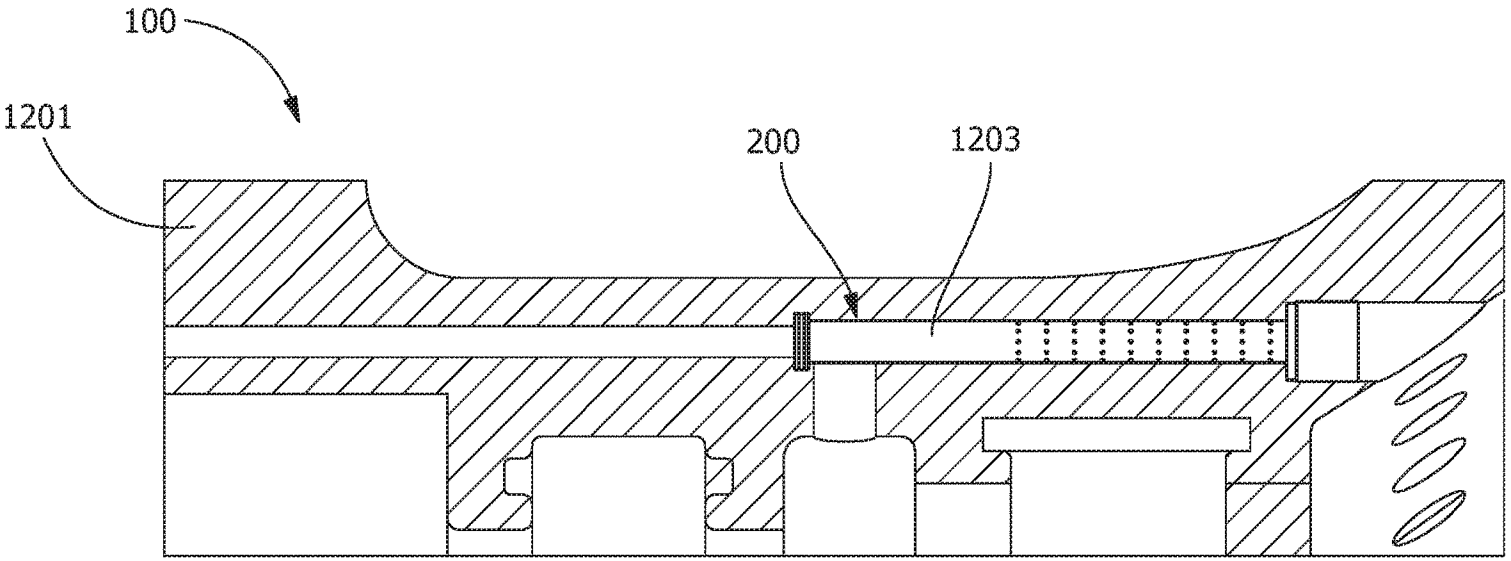
FIG. 12 is a section view of a device within an article, according to various additional embodiments of the disclosure.
Figure 13:
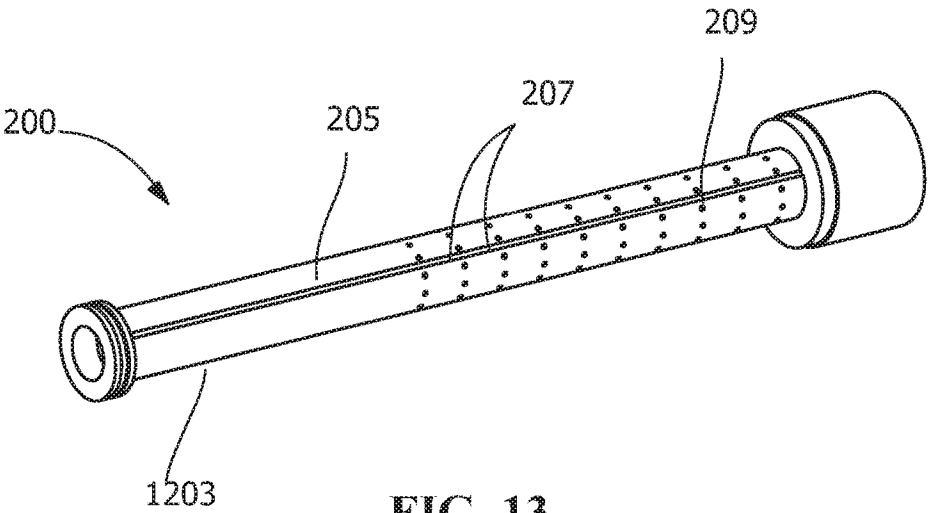
FIG. 13 is a perspective view of the device of FIG. 12, according to various embodiments of the disclosure.

Although described primarily herein with regard to a turbine bucket, the article 100 and device 200 are not so limited, and may include any other suitable article and/or device. For example, in one embodiment, as illustrated in FIGS. 12-13, the article 100 includes a turbine shell 1201 and the device 200 includes an (e.g., curved and/or cylindrical) impingement sleeve 1203. Impingement sleeve 1203 can include a plurality of the apertures 207 formed therein, where apertures 207 are configured to direct a cooling fluid toward turbine shell 1201 surrounding impingement sleeve 1203. Additionally, cylindrical impingement sleeve 1203 may include one or more of fluid receiving features 209 formed in outer surface 205 thereof. Apertures 207 are configured to direct the heat transfer (e.g., cooling) fluid from curved outer surface 205 of impingement sleeve 1203 to the curved surface of turbine shell 1201 to form wall jets directed back into fluid receiving features 209 in the impingement sleeve 1203. Other suitable articles include, but are not limited to, a hollow component, a hot gas path component, a shroud, a nozzle, a vane, or a combination thereof. For any of the other suitable articles, a geometry of the device 200 is selected to facilitate positioning of the device 200 within the article 100.

Figure 15:
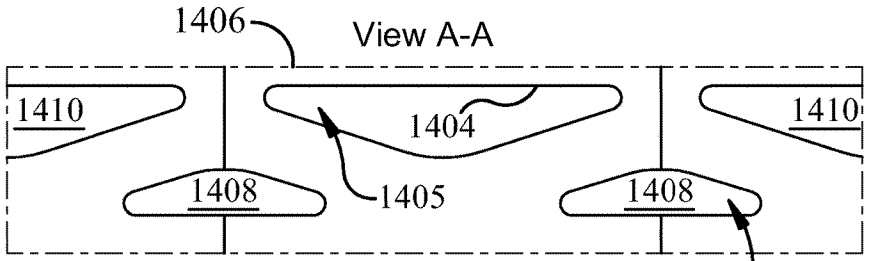
FIG. 15 shows a section view of the article of FIG. 14, through section A-A depicted in FIG. 14, according to various embodiments of the disclosure.
Figure 16:
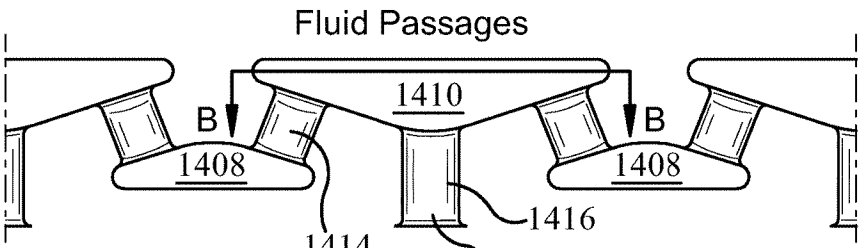
FIG. 16 shows a schematic depiction of a fluid passage within the article of FIG. 14, according to various embodiments of the disclosure.
Figure 17:
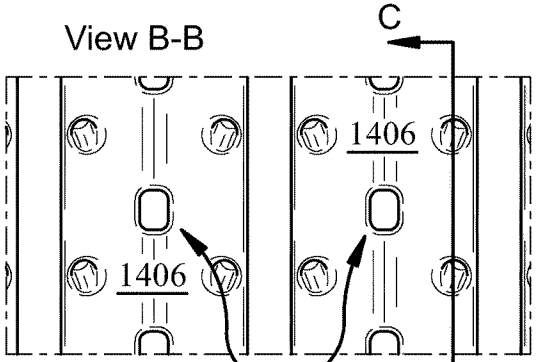
FIG. 17 shows a close-up cut-away view of a portion of the article depicted in FIG. 14, through section B-B depicted in FIG. 16, according to various embodiments of the disclosure.
Figure 18:
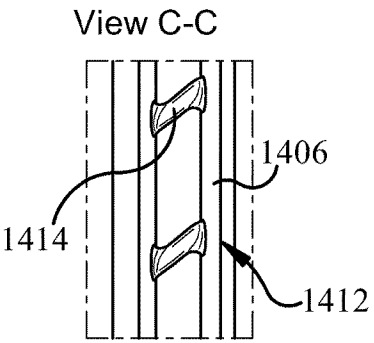
FIG. 18 shows a cut-away view of the article in FIG. 17, through section C-C, according to various embodiments of the disclosure.
Figure 14:
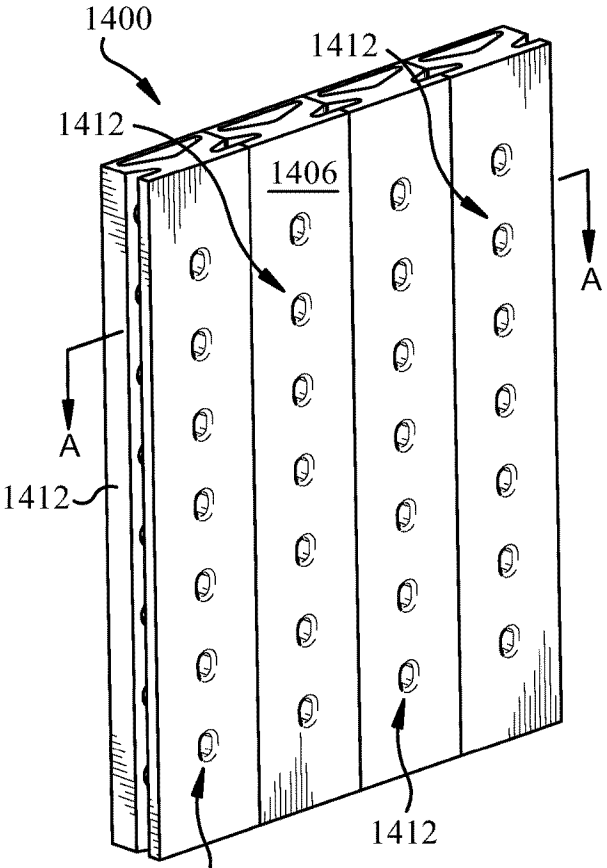
FIG. 14 is a perspective view of a section of an article according to various embodiments of the disclosure.
Figure 19:
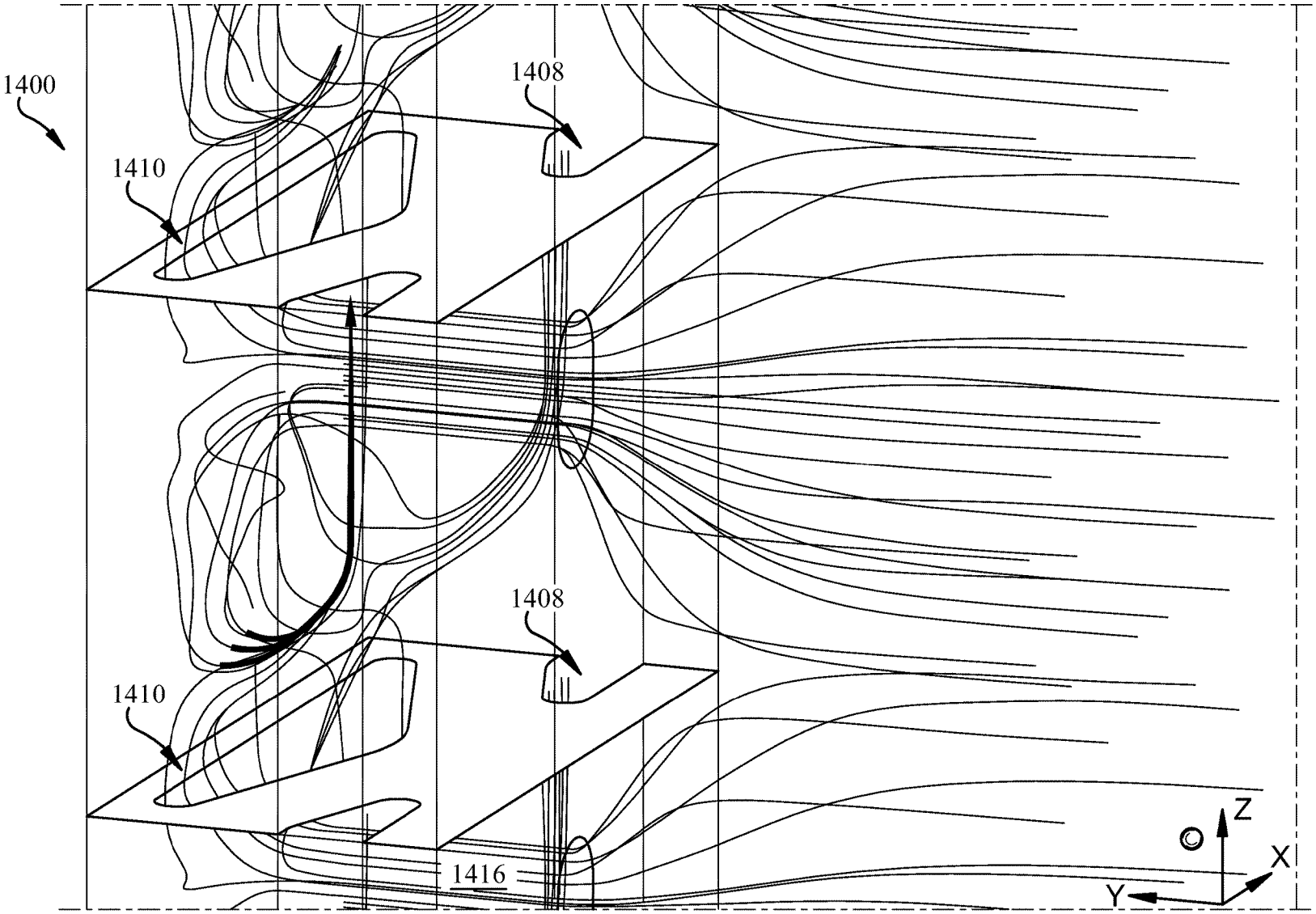
FIG. 19 shows cut-away perspective view of a portion of the article of FIG. 14, further illustrating flow characteristics within the article.

FIG. 14 shows a schematic perspective view of a portion of an article (turbine component, such as a turbine airfoil) 1400 according to various embodiments. FIG. 15 shows a cross-section of the component 1400 through line A-A. As shown, turbine component 1400 includes a body portion 1402 having an inner surface 1404 and an outer surface 1406, where inner surface 1404 defines an inner region 1405. Inner region 1405 can include a first set of passageways 1410 having a first volume and a second set of passageways 1408 fluidly coupled with the first set of passageways 1410, where second set of passageways 1408 have a second volume distinct from the first volume. Passageways 1408 and 1410 are shown schematically isolated in FIG. 16, illustrating the fluid connections between those passageways 1408, 1410 (e.g., spatial relationships and interconnection between passageways 1408, 1410). FIG. 17 illustrates a close-up view of the portion of turbine component 1400 (e.g., airfoil) viewed from line B-B in FIG. 15, while FIG. 18 shows a cross-sectional view of turbine component 1400, from line C-C in FIG. 17. FIG. 19 shows a cut-away perspective view of a portion of the turbine component 1400 of FIG. 14, further illustrating flow characteristics within the turbine component 1400. With reference to FIGS. 14-18, turbine component 1400 is shown further including at least one aperture 1412 in body portion 1402, where aperture(s) 1412 are positioned to direct fluid (e.g., heat transfer fluid) through conduit 1416 and to impinge upon inner surface 1404.

In some cases, turbine component 1400 (e.g., turbine airfoil) further includes at least one coupling conduit 1414 connecting each of first set of passageways 1410 with an adjacent one of second set of passageways 1408. According to various embodiments, heat transfer fluid travels through conduit 1416, impinges upon inner surface 1404, travels along surface 1404, then travels away from surface 1404 as post-impingement flow in one or more wall jets as described herein. One or more coupling conduits 1414 may be located to collect and segregate high-velocity post-impingement flow from relatively lower-velocity cross-flow and route the relatively higher-velocity flow into second set of passageways 1408.

While the invention has been described with reference to one or more embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. In addition, all numerical values identified in the detailed description shall be interpreted as though the precise and approximate values are both expressly identified.

What is claimed is:

1. A device, comprising:

a body portion having an inner surface and an outer surface, the inner surface defining an inner region;

at least one aperture in the body portion, the at least one aperture positioned to direct fluid from the inner region through the body portion; and at least one fluid receiving feature formed in the outer surface of the body portion, the at least one fluid receiving feature positioned to receive post-impingement fluid from the at least one aperture;

wherein the at least one aperture does not define any portion of the at least one fluid receiving feature, and the at least one fluid receiving feature segregates relatively higher velocity post-impingement fluid from relatively lower velocity fluid within an impingement cross-flow region.

2. The device of claim 1, wherein the at least one fluid receiving feature further comprises a fluid directing feature.

3. The device of claim 2, wherein the fluid directing feature is formed within the fluid receiving feature.

4. The device of claim 2, wherein the fluid directing feature comprises a turning vane positioned within an opening of the fluid receiving feature.

5. The device of claim 2, wherein the fluid directing feature directs the post-impingement fluid within the fluid receiving feature.

6. The device of claim 2, wherein the fluid directing feature directs the post-impingement fluid away from the at least one aperture.

7. The device of claim 1, wherein the at least one aperture is angled between 75° and 89° with respect to the outer surface of the body portion.

8. The device of claim 7, wherein the at least one aperture is angled in a cross flow direction.

9. The device of claim 1, further comprising a primary bellmouth aligned with each aperture, the primary bellmouth being positioned to direct fluid into the aperture aligned therewith.

10. The device of claim 9, further comprising a secondary bellmouth that is not aligned with the at least one aperture, the secondary bellmouth being positioned to direct fluid into the at least one aperture.

11. The device of claim 10, wherein the secondary bellmouth is positioned to direct fluid into at least two apertures that are not aligned therewith.

12. The device of claim 1, wherein the at least one fluid receiving feature directs at least a portion of the post-impingement fluid back through the at least one aperture.

13. The device of claim 1, wherein the fluid receiving feature reduces cross flow generated by the fluid exiting the at least one aperture.

14. The device of claim 1, wherein the at least one fluid receiving feature is partially enclosed by the body portion.

* * * * *